United States Patent [19]

Kosuge

[11] Patent Number: 4,523,561

[45] Date of Patent: Jun. 18, 1985

[54] APPARATUS AND METHOD FOR CONTROLLING AIR AMOUNT UPON ENGINE START

[75] Inventor: Tokuo Kosuge, Katsuta, Japan

[73] Assignee: Hitachi, Ltd., Tokyo, Japan

[21] Appl. No.: 515,967

[22] Filed: Jul. 21, 1983

[30] Foreign Application Priority Data

Jul. 26, 1982 [JP] Japan ..... 57-128953

[51] Int. Cl.[3] ..... F02D 33/02

[52] U.S. Cl. ..... 123/339; 123/179 A; 123/179 B; 123/179 G; 123/361

[58] Field of Search ..... 123/339, 340, 585, 376, 123/179 G, 341, 179 B, 352, 179 A, 361

[56] References Cited

U.S. PATENT DOCUMENTS

| | | | |
|---|---|---|---|
| 4,237,833 | 12/1980 | Des Lauriers | 123/339 |
| 4,344,398 | 8/1982 | Ikeara | 123/339 |
| 4,344,399 | 8/1982 | Matsumura et al. | 123/339 |
| 4,363,303 | 12/1982 | Takayama | 123/399 |
| 4,365,601 | 12/1982 | Yamazoe et al. | 123/339 |
| 4,378,766 | 4/1983 | Yamazoe et al. | 123/339 |
| 4,380,979 | 4/1983 | Takase | 123/339 |
| 4,402,288 | 9/1983 | Ohgami et al. | 123/339 |
| 4,429,671 | 2/1984 | Suraue | 123/339 |
| 4,440,128 | 4/1984 | Nakano et al. | 123/179 B |

*Primary Examiner*—Raymond A. Nelli

*Attorney, Agent, or Firm*—Antonelli, Terry & Wands

[57] ABSTRACT

An apparatus for controlling air amount upon engine start comprises a control signal generator which provides control signals indicative of amounts of air required upon start of an internal combustion engine and corresponding to temperatures of the engine. An amount of air required upon engine start is derived from the control signal generator in accordance with an engine temperature upon the engine start to control air amount thereupon.

7 Claims, 4 Drawing Figures

APPARATUS AND METHOD FOR CONTROLLING AIR AMOUNT UPON ENGINE START

BACKGROUND OF THE INVENTION

This invention relates to apparatus and method for controlling the amount of air required upon start of internal combustion engines.

An apparatus for controlling the amount of air required for an internal combustion engine from engine start until termination of warm-up operation is well known as a so-called idle speed control apparatus which is disclosed in U.S. Pat. No. 3,964,457.

In this idle speed control apparatus, target values of engine revolution corresponding to cooling water temperatures are stored in a function generator, and a value representative of an actual revolution of the internal combustion engine is compared with a target value derived from the function generator to control the amount of air being supplied to the internal combustion engine so that the actual engine revolution can be converged to the target revolution.

In addition, the controlling function of such an idle speed control apparatus is deactivated upon start especially cranking of the internal combustion engine and in this case, an air control mechanism is activated so that a maximum amount of air required for engine start can be supplied to the internal combustion engine.

The maximum air amount is however definitely set irrespective of temperatures of the internal combustion engine and hence the same amount of air is supplied to the internal combustion engine even under conditions of different engine temperatures, thus adversely affecting the internal combustion engine.

An object of this invention is to provide apparatus and method for controlling air amount upon engine start which can supply amounts of air required upon engine start in accordance with temperatures of an internal combustion engine.

This invention is featured in that a control signal generator is provided which provide control signals indicative of amounts of air required upon engine start and corresponding to temperatures of an internal combustion engine, and an amount of air required upon engine start is derived from the control signal generator in accordance with an engine temperature upon the engine start to control air amount thereupon.

BRIEF DESCRIPTION OF THE DRAWINGS

The present invention will be apparent from the following detailed description taken in conjunction with the accompanying drawings, in which.

DETAILED DESCRIPTION OF THE DISCLOSED EMBODIMENT

Figure 1:
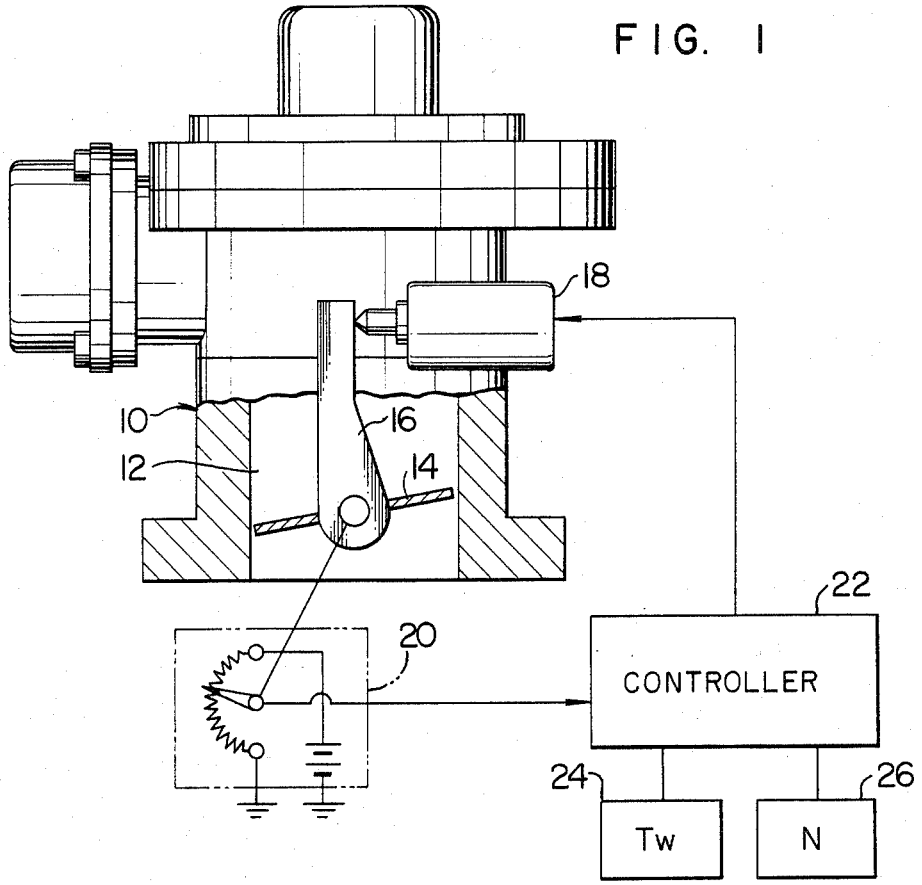
FIG. 1 is a schematic view showing one embodiment of an air control apparatus according to the invention.

Referring to FIG. 1, a throttle valve body 10 has an interior air intake conduit 12 in which a throttle valve 14 is rotatably mounted. Fixed to the throttle valve 14 is a throttle valve lever 16 which is actuated by a drive unit 18 to rotate the throttle valve 14 so that the throttle valve 14 is opened or closed to control the amount of air being supplied to an internal combustion engine.

For illustration purpose only, the drive unit 18 takes the form of a DC motor but it may be in the form of a proportional solenoid, a pneumatic motor or the like.

Coupled to the throttle valve 14 is an angle sensor 20, for example, in the form of a potentiometer adapted to detect an open angle of the throttle valve 14 which is measured with respect to a reference angular position.

Signals from the angle sensor 20 are applied to a stored program type digital computer 22 which is constituted by, for example, a microcomputer and hereinafter referred to as a controller.

Figure 2:
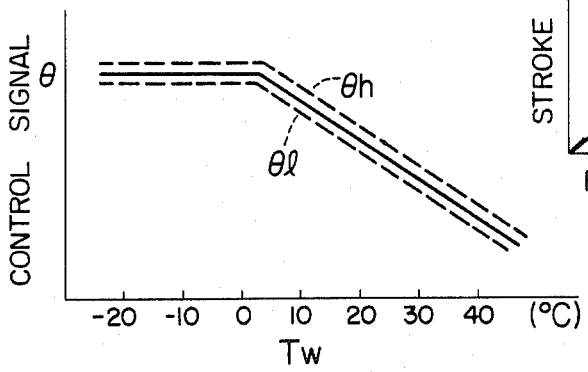
FIG. 2 is a graphic representation showing the relation between cooling water temperature and control signal.

Also applied to the controller 22 are signals from a temperature sensor 24 adapted to detect temperatures $T_W$ of cooling water for the internal combustion engine and signals from a revolution sensor 26 adapted to detect rotation speeds of the internal combustion engine. Built in the controller 22 is a memory in the form of a read only memory, for example, in which a binary data of a control characteristic as shown in FIG. 2 is stored. The characteristic of FIG. 2 is illustrative of control signals $\theta$ applied to the drive unit 18 corresponding to temperatures of cooling water, and in this embodiment, the control signal is converted into a corresponding number of pulses which are to be applied to the DC motor. A pulse number is representative of an opening of the throttle valve 14, in other words, an amount of air to be supplied to the internal combustion engine.

In this manner, amounts of air corresponding to cooling water temperatures upon start of the internal combustion engine can be obtained.

Figure 3:
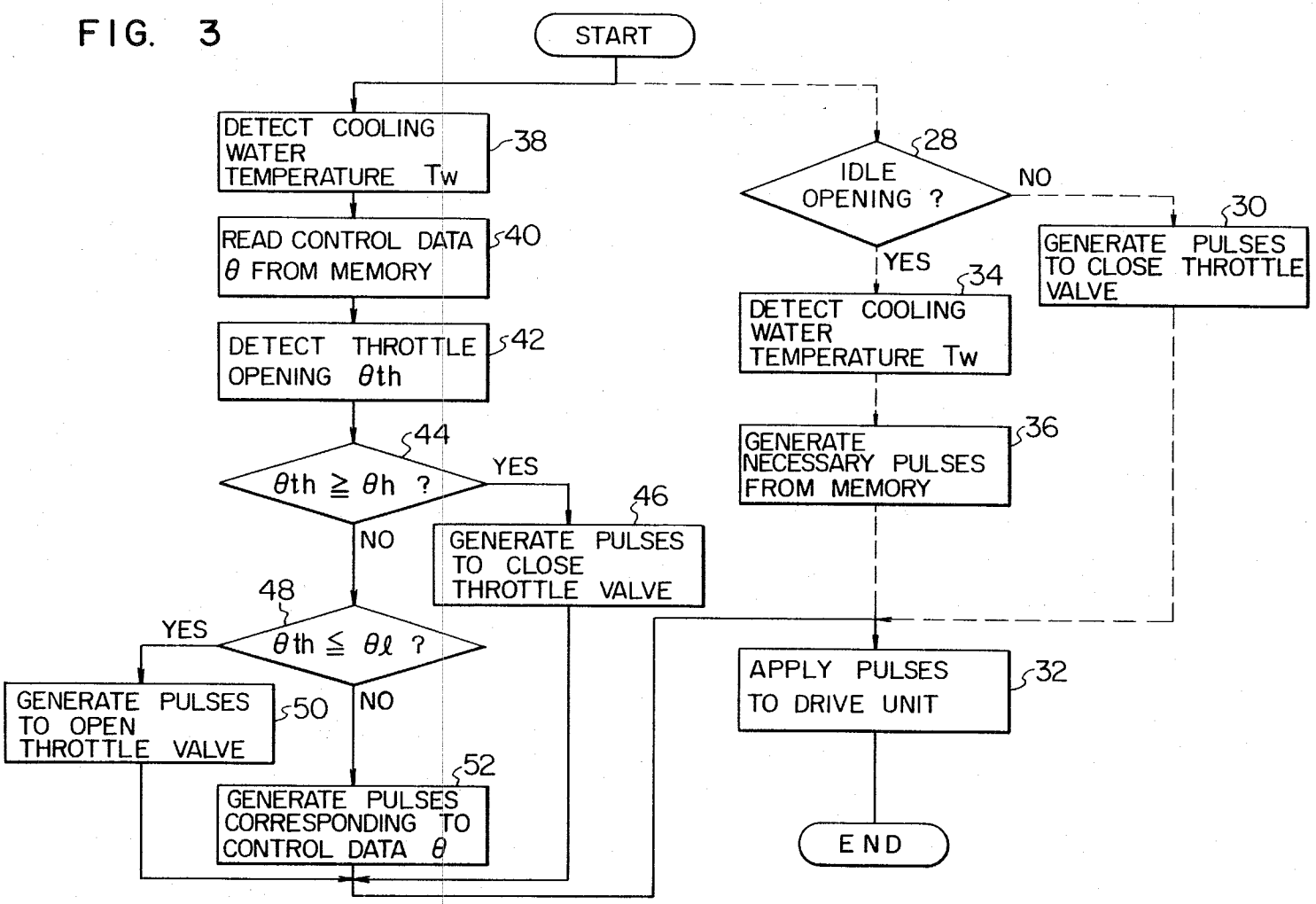
FIG. 3 is a flow chart illustrative of an air control method embodying the invention.

The operation of the apparatus will now be described with reference to a flow chart as shown in FIG. 3.

In FIG. 3, an ignition switch for starting the internal combustion engine is first turned on. Subsequently, it is detected in step 28 as to whether or not the throttle valve 14 is conditioned to have an idle opening. The idle opening is detected by a separate idle switch. If the throttle valve 14 is not with the idle opening, a control signal for closing the throttle valve 14 is generated in step 30 so that the throttle valve 14 may be restored to the idle opening, and a pulse signal based on this control signal is applied to the drive unit 18 in step 32.

If it is judged in the step 28 that the throttle valve 14 is conditioned to have the idle opening, a temperature of cooling water is detected in step 34 and a control signal $\theta$ corresponding to that cooling water temperature is read out of the memory in accordance with the characteristic of FIG. 2 in step 36 to thereby determine a pulse number corresponding to the control signal.

Subsequently, in the step 32, pulses are applied to the drive unit 18 so that an opening of the throttle valve 14 may be set on the basis of this pulse number. After completion of the application of the pulses, a starter switch is turned on to start the internal combustion engine.

Consequently, upon engine start, the throttle valve 14 is conditioned to have the opening in accordance with the engine temperature and therefore excellent start of the internal combustion engine can be accomplished.

Through the steps 28, 34 and 36, the opening of the throttle valve 14 can basically be determined but a problem may arise as described below.

More particularly, the drive unit 18 is a mechanical component and when considering a DC motor standing for the drive unit 18, the stroke of the shaft of DC motor (movement of the shaft for moving the throttle valve lever 16) is affected by viscosity of lubricating oil applied to a speed reduction gear train and the shaft and it will therefore vary even when the same number of pulses is applied to the DC motor.

Figure 4:
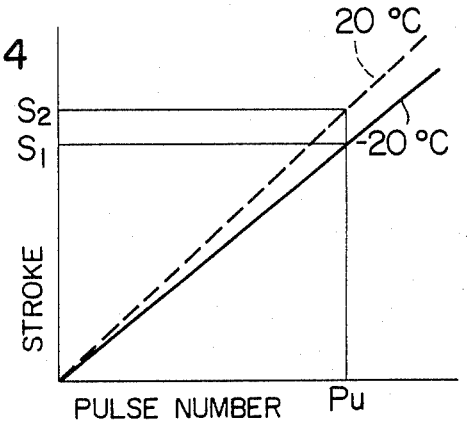
FIG. 4 is a graphic representation showing the relation between ambient temperature and output of a drive unit.

FIG. 4 shows how the stroke varies for the same number of pulses with parameters of ambient temperatures of −20° C. and +20° C., exhibiting that the lower the temperatures, the smaller the stroke becomes.

Accordingly, the flow procedure through the steps 28, 34 and 36 will raise the problem that changes in output of the drive unit 18 dependent on the ambient temperatures can not be corrected.

To obviate the above problem, a countermeasure to be described below is effective.

Turning to FIG. 3, a temperature $T_w$ of cooling water is detected in step 38 and a control signal $\theta$ corresponding to this temperature is read out of the memory in accordance with the characteristic of FIG. 2 in step 40.

The control signal $\theta$ has a predetermined width as shown at dotted lines in FIG. 2, in other words, a blind zone defined by an upper limit $\theta h$ and a lower limit $\theta l$. This blind zone is effective to prevent hunting.

Subsequently, an opening $\theta th$ of the throttle valve 14 under this condition is detected in step 42 by using the angle sensor 20. The detected opening $\theta th$ is compared with the upper limit $\theta h$ of the control signal in step 44. If it is judged from the comparison that the actual opening $\theta th$ of the throttle valve is larger than the upper limit $\theta h$ of the control signal, correction pulses for closing the throttle valve 14 are generated in step 46 on the basis of $\theta h-\theta th$ and applied to the drive unit 18 in the step 32.

If, on the other hand, it is judged in the step 44 that the actual throttle valve opening $\theta th$ is smaller than the upper limit $\theta h$ of the control signal, this actual opening $\theta th$ is compared with the lower limit $\theta l$ in step 48.

If it is judged in the step 48 that the actual opening $\theta th$ is smaller than the lower limit $\theta l$, correction pulses for opening the throttle valve 14 are generated in step 50 on the basis of $\theta l-\theta th$ and applied to the drive unit 18 in the step 32.

If, on the other hand, it is judged in the step 48 that the actual throttle valve opening $\theta th$ is larger than the lower limit $\theta l$ of the control signal, indicating that this actual opening $\theta th$ falls within the blind zone defined by the upper and lower limits $\theta h$ and $\theta l$, pulses corresponding to the control signal $\theta$ are generated in step 52 and applied to the drive unit 18 in the step 32.

After completion of this flow procedure, the starter switch is turned on to start the internal combustion engine.

In this manner, an accurate opening of the throttle valve corresponding to the control signal $\theta$ can be obtained.

While in the foregoing embodiment the throttle valve is used by itself for air amount controlling, an air amount control valve may alternatively be provided in a conduit which by-passes the throttle valve and the opening of the air amount control valve may be controlled.

I claim:

1. An apparatus for controlling air amount during cranking of an engine to start said engine comprising:

an air intake conduit for supply of air to an internal combustion engine;

air amount control means for regulating amounts of air to be supplied to said internal combustion engine;

memory means stored with control data represensitive of predetermined amounts of air required during cranking to start said engine and corresponding to temperatures of said engine;

temperature detection means for detecting temperatures of said internal combustion engine and generating temperature signals;

opening detection means for detecting the opening of said air amount control means to produce an opening signal;

control means for reading a control data from said memory means on the basis of a temperature signal from said temperature detection means and examining the read out control data and said opening signal from said opening detection means to produce a drive signal on the basis of said control data when the opening signal from said opening detection means coincides with said control data under a predetermined relationship and to produce a drive signal on the basis of a correction signal for bringing the opening signal into coincidence with the control data under the predetermined relationship when said opening signal does not coincide with said control data under the predetermined relationship; and drive means driven by the drive signal from said control means, for driving said air amount control means so as to supply to said internal combustion engine an amount of air required during cranking to start said engine.

2. The apparatus according to claim 1 wherein said air amount control means comprises a throttle valve disposed in said air intake conduit, and said drive means comprises an electric motor which controls the opening of said throttle valve.

3. The apparatus according to claim 1 wherein said memory means comprises a semiconductor memory stored with binary data, and said control means comprises a digital computer.

4. The apparatus according to claim 3 wherein the data stored in said semiconductor memory and representative of the amount of air required during cranking to start said engine has a blind zone of a predetermined width which is defined by upper and lower limits.

5. A method for controlling air amount during cranking to start and engine adapted for an apparatus for controlling the amount of air during cranking to start the engine in which air amount control means adapted to control the amount of air required during cranking to start an internal combustion engine is controlled by drive means driven by the output of a digital computer, said method comprising:

a first step of detecting temperatures of said internal combustion engine by means of a temperature sensor to produce temperature signals;

a second step of reading, from a semiconductor memory stored with control data representative of predetermined amounts of air required during cranking to start said engine and corresponding to a temperature signal detected in the first step;

a third step of detecting the opening of said air amount control means of an opening sensor to produce an opening signal;

a fourth step of examining the control data read out in the second step and the opening signal detected in the third step;

a fifth step of determining a drive signal applied to said drive means on the basis of said control data when it is judged in the fourth step that said control data coincides with said opening signal under a predetermined relationship;

a sixth step of determining a drive signal applied to said drive means on the basis of a correction signal for bringing the opening signal into coincidence with the control data under the predetermined relationship when it is judged in the fourth step that said opening signal does not coincide with said control data under the predetermined relationship; and a seventh step of applying the drive signals determined in the fifth and sixth steps to said drive means.

6. The method according to claim 5 wherein a control data stored in said semiconductor memory and having a blind zone of a predetermined width which is defined by upper and lower limits and said opening signal are examined in the fourth step.

7. The method according to claim 5 wherein said correction signal corresponds to a difference between said control data and said opening signal and a drive signal corresponding to the difference is determined in the sixth step.

* * * * *